US008985238B2

(12) United States Patent
Sorokan et al.

(10) Patent No.: US 8,985,238 B2
(45) Date of Patent: Mar. 24, 2015

(54) DRILLING RIG WITH HINGED, RETRACTABLE OUTRIGGERS

(75) Inventors: Ron Sorokan, Sherwood Park (CA); Kameron Wayne Konduc, Edmonton (CA)

(73) Assignee: National Oilwell Varco, L.P., Houston, TX (US)

( * ) Notice: Subject to any disclaimer, the term of this patent is extended or adjusted under 35 U.S.C. 154(b) by 531 days.

(21) Appl. No.: 13/264,033

(22) PCT Filed: Aug. 6, 2010

(86) PCT No.: PCT/US2010/044646

§ 371 (c)(1),
(2), (4) Date: Dec. 27, 2011

(87) PCT Pub. No.: WO2011/017584

PCT Pub. Date: Feb. 10, 2011

(65) Prior Publication Data

US 2012/0138327 A1 Jun. 7, 2012

Related U.S. Application Data

(60) Provisional application No. 61/232,075, filed on Aug. 7, 2009.

(51) Int. Cl.

| | |
|---|---|
| ***E21B 7/02*** | (2006.01) |
| ***E21B 15/00*** | (2006.01) |
| ***E21B 19/15*** | (2006.01) |

(52) U.S. Cl.

CPC . *E21B 7/02* (2013.01); *E21B 15/00* (2013.01); *E21B 7/023* (2013.01); *E21B 19/155* (2013.01)

USPC ..... 173/184; 173/26; 173/28; 173/185; 173/186; 173/187

(58) Field of Classification Search

CPC ..... E21B 7/02; E21B 15/00; E21B 19/155; E21B 7/023

USPC ..... 173/184–187, 26, 28

See application file for complete search history.

(56) References Cited

U.S. PATENT DOCUMENTS

| | | | | |
|---|---|---|---|---|
| 4,290,495 | A * | 9/1981 | Elliston | 175/85 |
| 4,899,832 | A | 2/1990 | Bierscheid | |
| 6,546,312 | B1 | 4/2003 | Matsumoto | |
| 2002/0003119 | A1 | 1/2002 | Rode | |
| 2007/0215359 | A1 | 9/2007 | Wood | |

OTHER PUBLICATIONS

Communication relating to the results of the International Search Report from counterpart International Application No. PCT/US10/44646 dated Aug. 6, 2010.

* cited by examiner

*Primary Examiner* — Michelle Lopez
(74) *Attorney, Agent, or Firm* — Amerson Law Firm, PLLC

(57) ABSTRACT

A mobile drill rig includes a frame structure and a plurality of hinged outriggers that are adapted to be retractable to a substantially vertical position during a drilling operation and extendable to a substantially horizontal position during movement of the mobile drill rig. The frame structure is adapted to transfer a weight of the mobile drill rig through the plurality of hinged outriggers to a plurality of wheeled frame dollies during the rig movement.

20 Claims, 7 Drawing Sheets

DRILLING RIG WITH HINGED, RETRACTABLE OUTRIGGERS

CROSS-REFERENCE TO RELATED APPLICATIONS

This is a 371 of PCT/US10/44646, filed Aug. 6, 2010, which claimed priority from U.S. provisional patent application Ser. No. 61/232,075, filed Aug. 7, 2009.

FIELD OF THE INVENTION

The present invention is drawn to oilfield drilling structures which may be easily moved from one drilling position to another by use of outboard, hinged outriggers. These structures are useful in drilling oil wells in fields where a great many boreholes are required to sustain the production of oil. The invention further provides a drill rig having features which allow it to be transported along roadways from one oilfield drilling location to another.

DESCRIPTION OF THE RELATED ART

There are numerous patents and publication regarding 'mobile' oil well drilling rigs that may be transported in a 'stowed' mode along public highways and which may also be moved in an 'erected' mode when drilling multiple adjacent wells within a particular oil field. One such patent, U.S. Pat. No. 3,754,361, incorporated by reference herein for all it discloses, discussed a wheeled structure to transport a drilling rig with rotatable wheel assemblies which allow the rig to be moved by using a 'fifth wheel' arrangement which may be rotated to any angle. These wheels are permanently attached, however, which may consume considerable space and add unnecessary weight.

U.S. Pat. No. 4,375,892 discloses a more flexible 'dolly type' structure which also allows a rig to be moved in any desired direction. However, this structure shares many of the same general problems as U.S. Pat. No. 3,754,361, as described above.

Furthermore, U.S. Pat. Nos. 4,305,237; 4,290,495; 3,807,109; 4,823,953; 4,823,870 and US Publication number 2007/0215359 all show various arrangements for movable drill rigs.

BRIEF SUMMARY OF THE INVENTION

The present disclosure is generally directed to mobile drilling rig structures with hinged retractable outriggers. In one illustrative embodiment, a mobile drill rig includes, among other things, a frame structure and a plurality of hinged outriggers that are adapted to be retractable to a substantially vertical position during drilling operation and extendable to a substantially horizontal position during movement of the mobile drill rig. Furthermore, the frame structure is adapted to transfer a weight of the mobile drill rig through the plurality of hinged outriggers to a plurality of wheeled frame dollies during the rig movement.

In another exemplary embodiment, a hinged outrigger is disclosed that is operatively coupled to a mobile drill rig, and at least one servomechanism is operatively coupled to the hinged outrigger. The hinged outrigger is adapted to be retractable to a substantially vertical position during a drilling operation and extendable to a substantially horizontal position during movement of the mobile drill rig. Additionally, the hinged outrigger is further adapted to transfer weight of the mobile drill rig from a frame structure to one or more wheeled frame dollies during the rig movement. Furthermore, the at least one servomechanism includes at least one of a hydraulic servomechanism and a pneumatic servomechanism and is adapted to provide extension and retraction of the hinged outrigger and to facilitate electronic coordination of the rig movement.

DETAILED DESCRIPTION OF THE INVENTION

Figure 1:
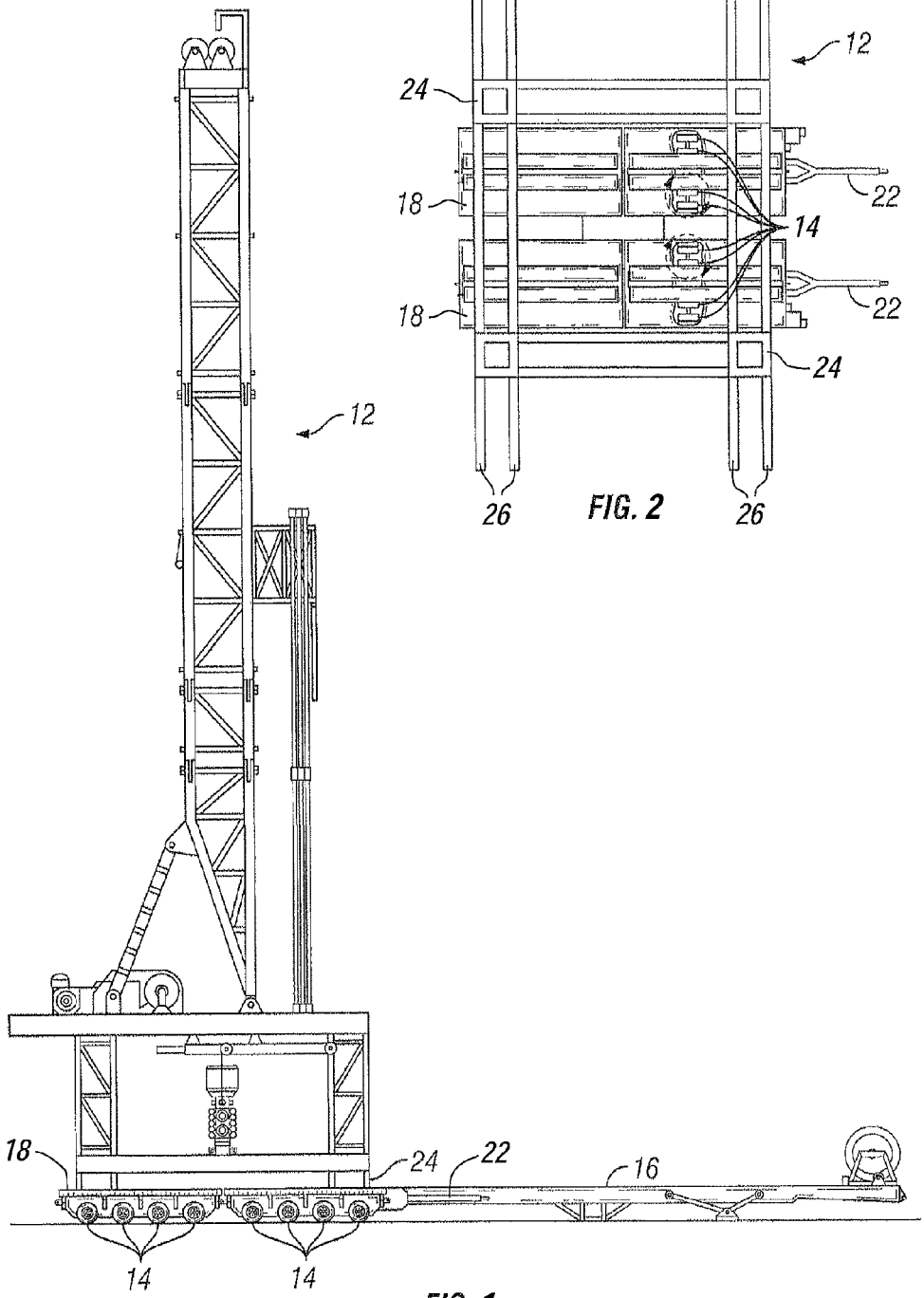
FIG. 1 is a side elevation view of a drill rig of the present invention.
Figure 3:
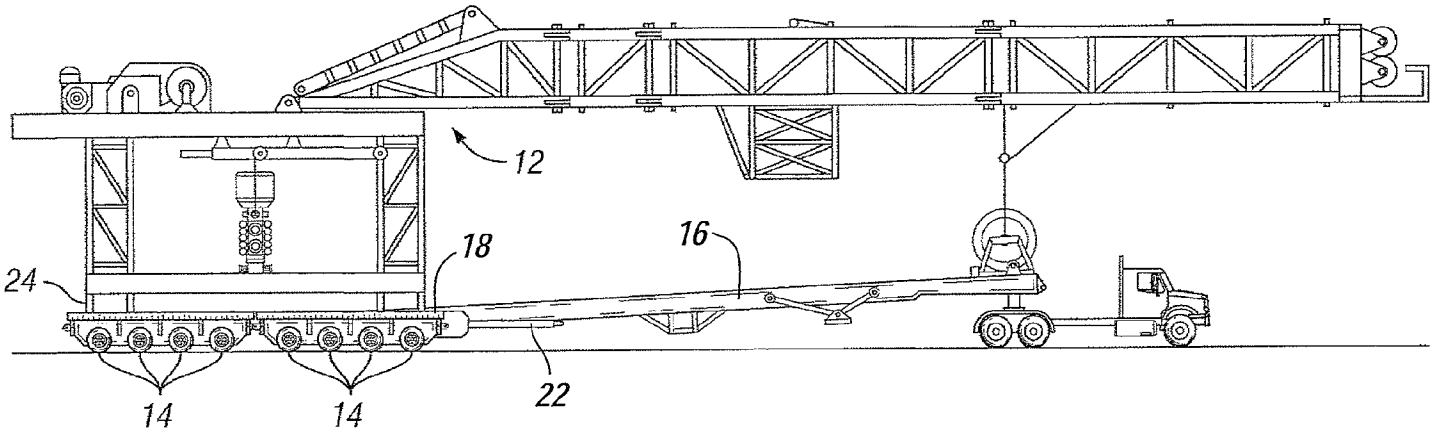
FIG. 3 is a side elevation view of the drill rig of FIG. 1 arranged for transport along a public highway.

Turning now to FIG. 1, the drill rig 12 of the present invention is a transportable type of drilling rig which allows it not only to be moved short distances such as the several hundred feet from one wellbore to be drilled to the next as illustrated in the configuration shown in FIG. 1, but which also may be disassembled, packaged and towed (as shown in FIG. 3) over public highways from one location to another which may be hundreds of miles apart.

Figure 2:
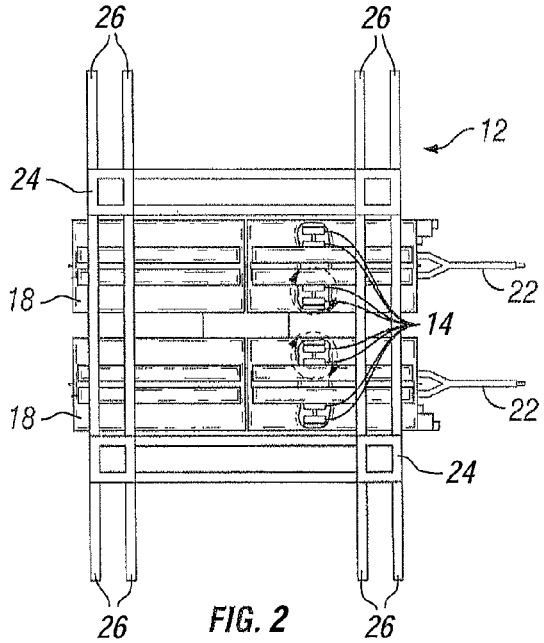
FIG. 2 is a cut-away top view of wheeled frame dollies arranged to lie within the support columns of the drill rig of FIG. 1.

Since a fully assembled drill rig 12 may weigh several hundred tons, moving it for even very short distance may be challenging. The drill rig 12 of the present invention may be placed upon one or more wheeled frame dollies 18, which are fitted with a number of wheels 14 (as shown in FIG. 1) and may be pulled along by a single towing bar 16. In some cases the wheeled dollies 18 with rotatable wheels 14 are towed to the next well site by each of their individual tow bars 22, as shown in FIG. 2.

Alternately, (and preferably) these dollies 18 may have motors built into their wheels 14 which allow them to be self propelled. In this case, each of the wheels 14 of the wheeled dollies 18 may be independently powered and individually and independently turned to the left or right to steer the drill rig 12 as it is being moved. In addition, the dollies 18 may have built-in jacking devices which allow them to be placed under the substructures 24 and elevated to contact and lift the drill rig 12. The drill rig 12 of the present invention as shown in FIGS. 1-10 is adapted to be carried upon these wheeled frame dollies 18.

Figure 4:
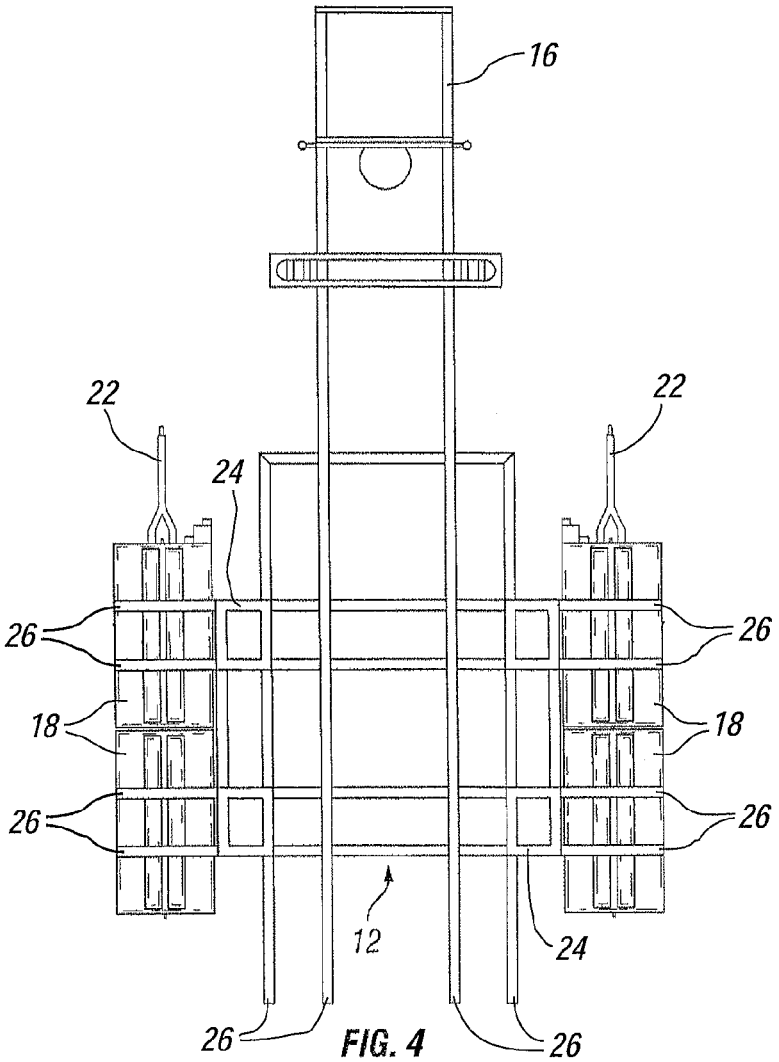
FIG. 4 is a top view of a cutaway portion of a structure similar to FIG. 1, to show wheeled frame dollies mounted outboard of the rig structure and carried on the hingable outriggers of the present invention.
Figure 5:
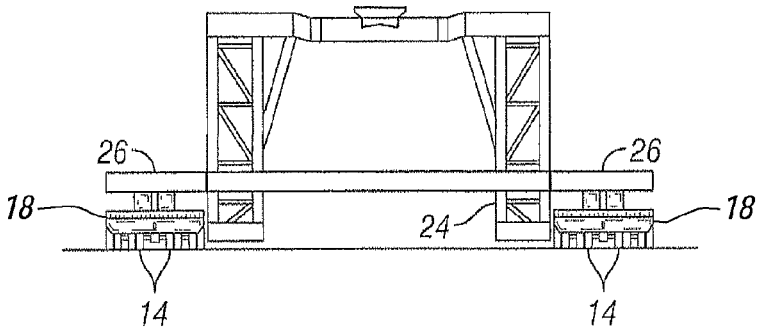
FIG. 5 is an end elevation view of the structure and hinged outriggers of FIG. 4.
Figure 6:
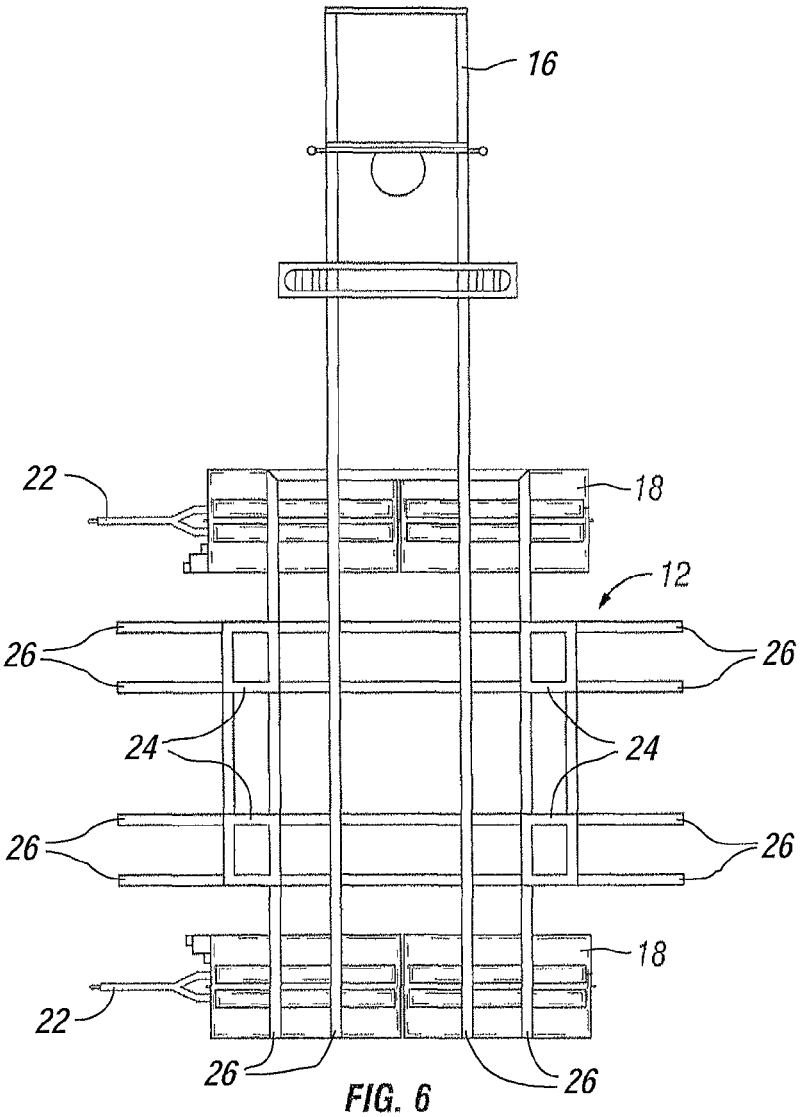
FIG. 6 is a top view of a cutaway portion of a structure similar to FIG. 1, to show wheeled frame dollies adapted to move the rig transversely, supported by the rig structure itself and with retracted hingable outriggers of the present invention.
Figure 7A:
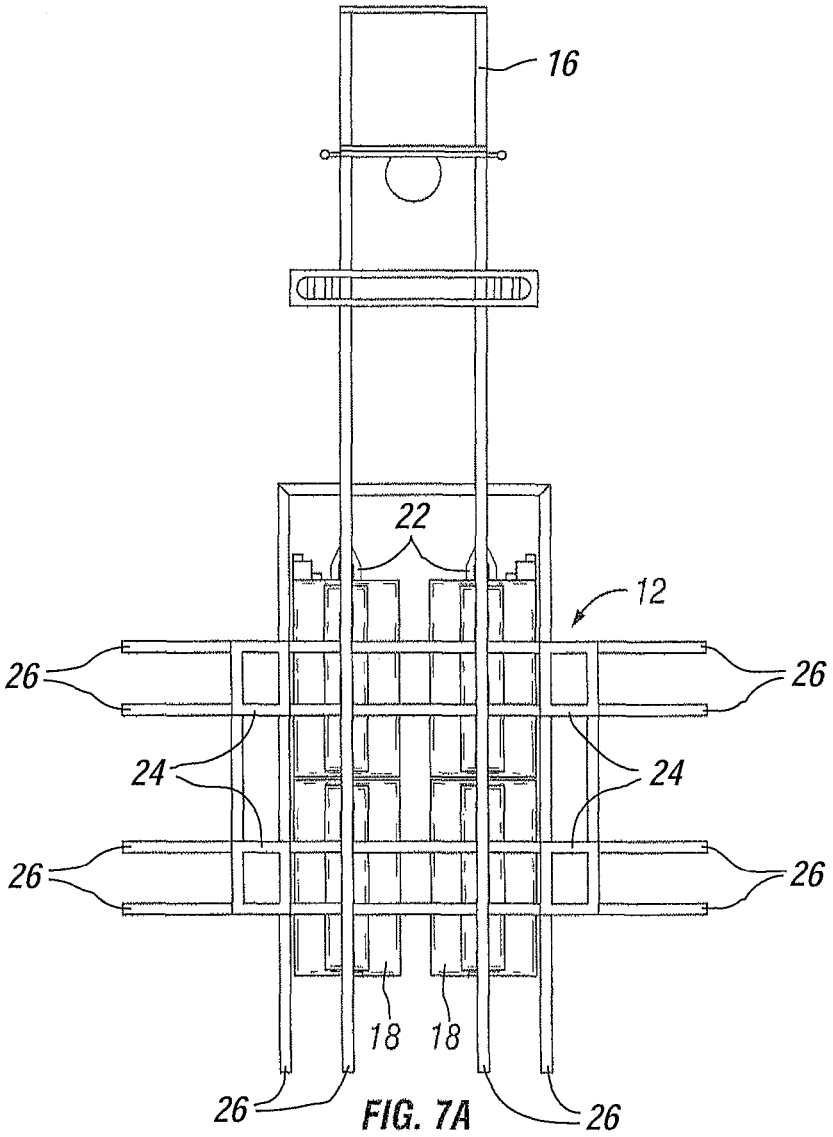
FIG. 7A is a top view of a cutaway portion of a structure similar to FIG. 1, showing wheeled frame dollies mounted inboard and supported by the rig structure itself and with retracted hingable outriggers of the present invention.
Figure 7B:
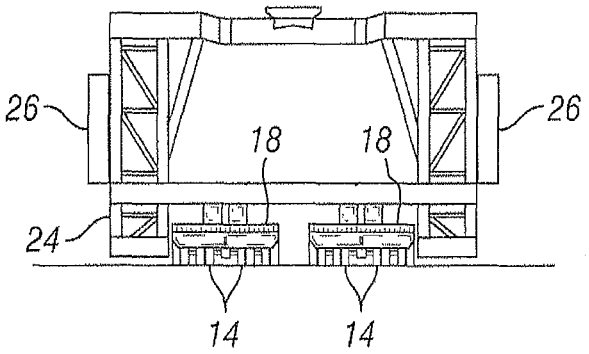
FIG. 7B is an end elevation view of the structure and retracted hinged outriggers of FIG. 7A.

In both ways of moving the rig 12 described above, there is a further option of placing the wheeled dollies 18 either under the drill rig 12 as shown in FIGS. 7A and 7B, or by placing the wheeled dollies 18 on either side of the outside portion of the drill 12 rig, as shown for example in FIGS. 4-6. In this case a pair of hinged outriggers 26 may be lowered and locked in place to transfer the weight of the rig to the wheeled frame dollies 18.

Figure 8A:
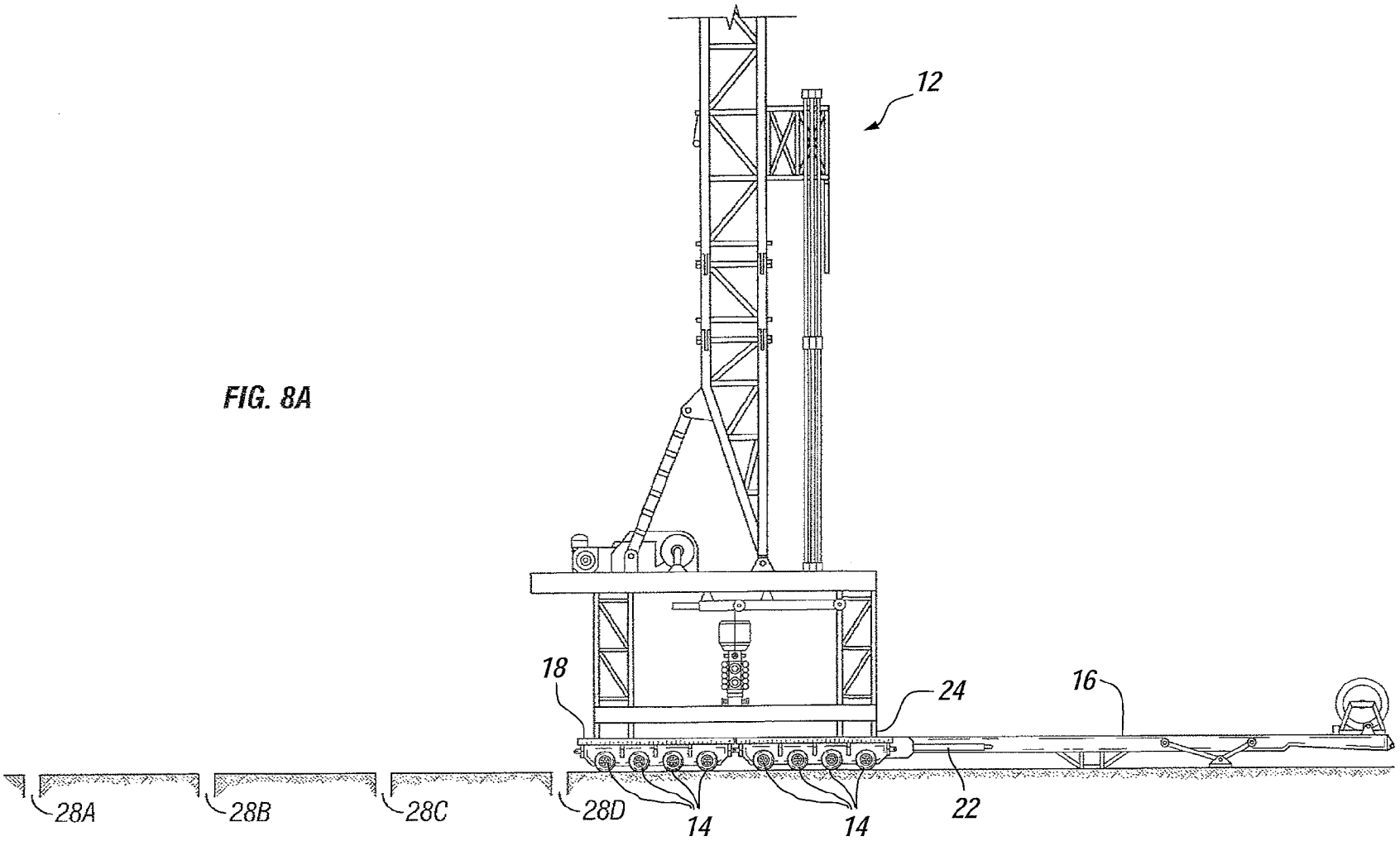
FIG. 8A is a side elevation view of a drill rig drilling a new borehole along a line of already drilled boreholes.
Figure 8B:
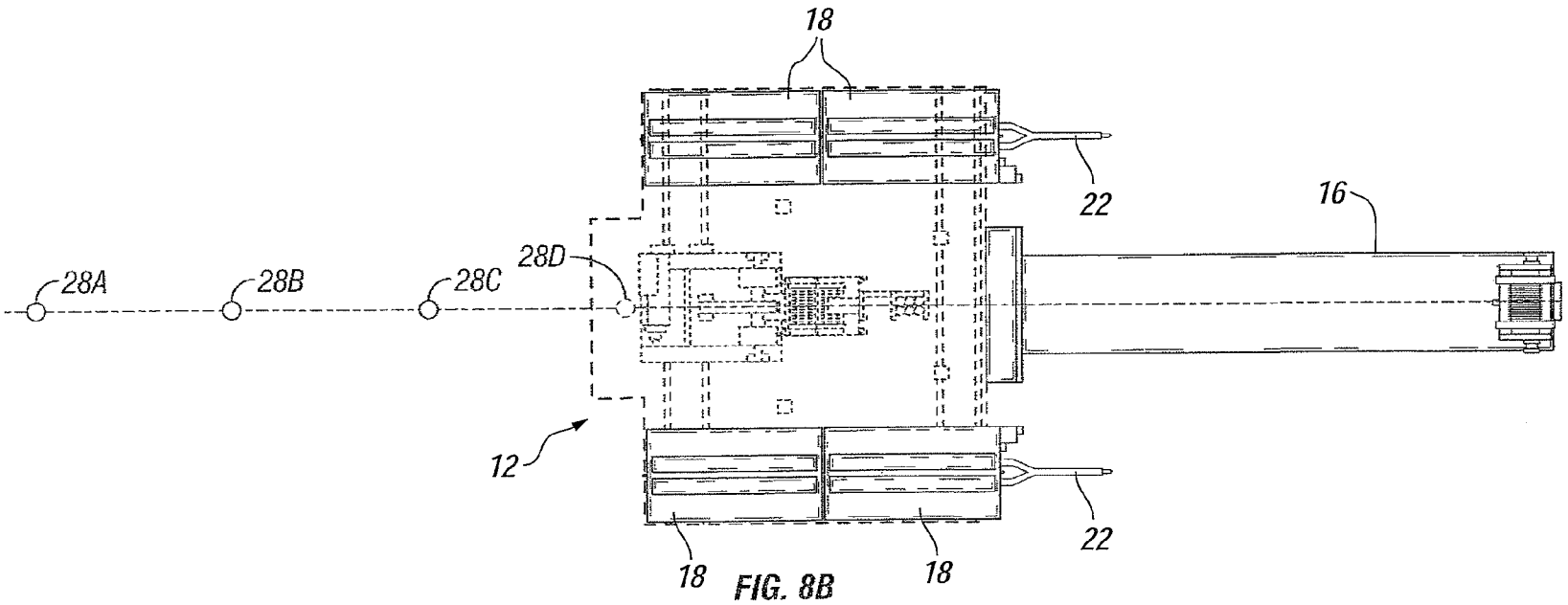
FIG. 8B is a top view of a cutaway portion of a structure similar to FIG. 8A.
Figure 10:
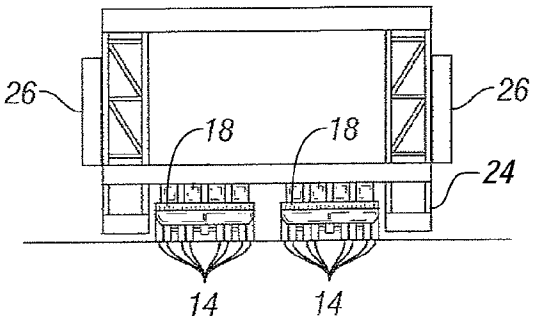
FIG. 10 is an end elevation view of a portion of a drill rig showing the retractable hinged outriggers in the retracted position.
Figure 9:
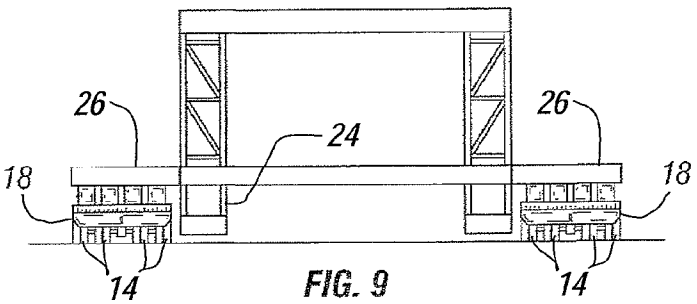
FIG. 9 is an end elevation view of a portion of a drill rig with the retractable hinged outriggers of the present invention carrying the load of the drill rig and transferring it to the wheeled frame dollies.

As oil fields become more depleted, it often requires many more boreholes to produce commercially amounts of oil. Also, some types of formations do not have good fluid communications. In both of these cases, it is often desirable to drill numerous boreholes in a grid pattern. FIG. 8B illustrates one such configuration for a line of boreholes 28A, 28B, 28C and 28D.

When this needs to be done, the task of moving the drill rig 12 becomes even more challenging, as it is now required to move both fore and aft, as well as left and right, as it moves from one line to the next. In the prior art drill rigs, the rig had to be rotated 90 degrees to make this turn, as the wellbore of the previously drilled wells may restrict the movement of the rigs—as shown for example in FIGS. 8A and 8B, which are side, and plan views of the drill rig 12 of the present invention drilling another in a series of boreholes 28A, 28B, 28C, 28D.

Again, because the drill rig 12 of the present invention has the capability of moving both laterally with the wheeled frame dollies 18, and longitudinally by utilizing the hinged outriggers 26 with the wheeled frame dollies 18, this formerly daunting task of a combination of lateral and longitudinal movement may be accomplished in far less time with far less risk of damaging the drill rig 12 or the other equipment at the site, as compared with present practice. Furthermore, the hinged outriggers 26 of the present invention may include the use of conventional hydraulic, pneumatic, servo type mechanisms, which could provide for automatic extension/retraction, and allow for electronic coordination of movement. This may be combined with other systems, and allow electronic synchronization with other rig equipment for very complex moving tasks, where multiple devices may be optionally controlled with computerized control systems.

A further advantage of the hinged outriggers is that when the rig 12 is partially dismantled for transport (as shown in FIG. 3) the load may be narrower because when stowed, the outriggers may no longer protrude beyond the frame structure of the rig.

Whereas the present invention has been described in particular relation to the drawings attached hereto, it should be understood that other and further modifications apart from those shown or suggested herein, may be made within the scope and spirit of the present invention.

What is claimed is:

1. A mobile drill rig, comprising:

a frame structure;

a plurality of hinged outriggers that are adapted to be retractable to a substantially vertical position during a drilling operation and extendable to a substantially horizontal position during movement of said mobile drill rig, wherein said frame structure is adapted to transfer a weight of said mobile drill rig through said plurality of hinged outriggers to a plurality of wheeled frame dollies during said movement.

2. The mobile drill rig of claim 1, wherein said frame structure is adapted to be placed on one or more wheeled frame dollies.

3. The mobile drill rig of claim 1, further comprising a plurality of wheels mounted on each of said wheeled frame dollies, wherein said mobile drill rig is adapted to be pulled along by a single towing bar.

4. The mobile drill rig of claim 3, wherein said movement is from one wellbore site to an adjacent wellbore site, wherein said mobile drill rig is adapted to be in a fully assembled condition during said movement from said one wellbore site to said adjacent wellbore site, and wherein said mobile drill rig is further adapted to be disassembled and packaged for highway transportation.

5. The mobile drill rig of claim 4, wherein said frame structure is adapted to be placed on one or more wheeled frame dollies.

6. The mobile drill rig of claim 5, wherein said mobile drill rig is adapted to be moved laterally during said movement using one or more wheeled frame dollies, and wherein said mobile drill rig is further adapted to be moved longitudinally during said movement using said one or more wheeled frame dollies with said plurality of hinged outriggers.

7. The mobile drill rig of claim 1, wherein said movement is from one wellbore site to an adjacent wellbore site, wherein said mobile drill rig is adapted to be in a fully assembled condition during said movement from said one wellbore site to said adjacent wellbore site, and wherein said mobile drill rig is further adapted to be disassembled and packaged for highway transportation.

8. The mobile drill rig of claim 1, further comprising one or more wheeled frame dollies that are adapted to facilitate said movement, wherein said movement is from one wellbore site to an adjacent wellbore site, wherein said mobile drill rig is adapted to be in a fully assembled condition during said movement, and wherein said mobile drill rig is further adapted to be disassembled and packaged during transportation of said mobile drill rig along a highway.

9. The mobile drill rig of claim 8, wherein said frame structure is adapted to be placed on said one or more wheeled frame dollies.

10. The mobile drill rig of claim 8, further comprising a plurality of wheels mounted on each of said wheeled frame dollies, wherein said mobile drill rig is adapted to be pulled along by a single towing bar.

11. The mobile drill rig of claim 1, wherein each of said plurality of hinged outriggers comprises at least one servomechanism operatively coupled thereto, wherein each of said at least one servomechanisms comprises at least one of an hydraulic servomechanism and a pneumatic servomechanism that is adapted to provide extension and retraction of said hinged outrigger and is integrated with a control system that is adapted to facilitate electronic coordination of said movement of said mobile drill rig.

12. The mobile drill rig of claim 11, wherein said mobile drill rig is adapted to be moved laterally during said movement using one or more wheeled frame dollies, and wherein said mobile drill rig is further adapted to be moved longitudinally during said movement using said one or more wheeled frame dollies with said plurality of hinged outriggers.

13. The mobile drill rig of claim 11, wherein said movement of said mobile drill rig is for a distance of at least approximately 100 feet from one wellbore site to an adjacent wellbore site.

14. A hinged outrigger operatively coupled to a mobile drill rig, the hinged outrigger comprising at least one servomechanism operatively coupled to said hinged outrigger, wherein said hinged outrigger is adapted to be retractable to a substantially vertical position during a drilling operation and extendable to a substantially horizontal position during movement of said mobile drill rig, wherein said hinged outrigger is further adapted to transfer weight of said mobile drill rig from a frame structure to one or more wheeled frame dollies during said movement, and wherein said at least one servomechanism comprises at least one of an hydraulic servomechanism and a pneumatic servomechanism and is adapted to provide extension and retraction of said hinged outrigger and to facilitate electronic coordination of said movement.

15. The hinged outrigger of claim 14, wherein said hinged outrigger is operatively coupled to a frame structure that is adapted to be placed on one or more wheeled frame dollies.

16. The hinged outrigger of claim 14, further comprising a plurality of wheels mounted on each of said wheeled frame dollies, wherein said hinged outrigger is adapted to facilitate towing of said mobile drill rig by a single towing bar.

17. The hinged outrigger of claim 16, wherein said movement is from one wellbore site to an adjacent wellbore site, wherein said hinged outrigger is adapted to facilitate said movement of said mobile drill rig when said mobile drill rig is in a fully assembled condition, and wherein said hinged outrigger is further adapted to be disassembled and packaged for highway transportation.

18. The hinged outrigger of claim 17, wherein said hinged outrigger is operatively coupled to a frame structure that is adapted to be placed on one or more wheeled frame dollies.

19. The hinged outrigger of claim 18, wherein said hinged outrigger is adapted to facilitate longitudinal movement of said mobile drill rig during said movement using said one or more wheeled frame dollies.

20. The hinged outrigger of claim 14, wherein said movement is from one wellbore site to an adjacent wellbore site, wherein said hinged outrigger is adapted to facilitate said movement of said mobile drill rig when said mobile drill rig is in a fully assembled condition, and wherein said hinged outrigger is further adapted to be disassembled and packaged for highway transportation.

* * * * *